US012656069B2

(12) United States Patent
Shin et al.

(10) Patent No.: US 12,656,069 B2
(45) Date of Patent: Jun. 16, 2026

(54) INTEGRATED PLATE-TYPE HEAT EXCHANGER

(71) Applicant: ESTRA AUTOMOTIVE SYSTEMS CO., LTD., Daegu (KR)

(72) Inventors: Young Sam Shin, Daegu (KR); Jun Ho Choi, Daegu (KR); Seong Yeob Lee, Daegu (KR)

(73) Assignee: ESTRA AUTOMOTIVE SYSTEMS CO., LTD., Daegu (KR)

( * ) Notice: Subject to any disclaimer, the term of this patent is extended or adjusted under 35 U.S.C. 154(b) by 107 days.

(21) Appl. No.: 18/708,688

(22) PCT Filed: Nov. 15, 2022

(86) PCT No.: PCT/KR2022/017965
§ 371 (c)(1),
(2) Date: May 9, 2024

(87) PCT Pub. No.: WO2023/096247
PCT Pub. Date: Jun. 1, 2023

(65) Prior Publication Data

US 2025/0003698 A1 Jan. 2, 2025

(30) Foreign Application Priority Data

Nov. 23, 2021 (KR) ..... 10-2021-0162283

(51) Int. Cl.
*F28F 3/08* (2006.01)
*F28D 21/00* (2006.01)
*F28F 3/12* (2006.01)

(52) U.S. Cl.
CPC ..... *F28F 3/08* (2013.01); *F28D 21/00* (2013.01); *F28F 3/12* (2013.01); *F28D 2021/008* (2013.01)

(58) Field of Classification Search
CPC .. B60H 1/3227; B60H 1/00342; B60H 1/143; F28D 9/005; F28D 9/0093; F28D 2021/008; F28D 21/00; F28F 3/08; F28F 3/12; F28F 27/02; F28F 2280/06; F28F 9/0253; F25B 1/00; F29F 2009/004
See application file for complete search history.

(56) References Cited

U.S. PATENT DOCUMENTS 10,480,871 B2 11/2019 Mueller et al.
2012/0060550 A1* 3/2012 Mann ..... F25B 39/00 62/513

(Continued)

FOREIGN PATENT DOCUMENTS

DE 202014101213 U1 * 4/2014 ..... F28D 9/005
KR 10-2018-0092543 A 8/2018

(Continued)

OTHER PUBLICATIONS

International Search Report for PCT/KR2022/017965 dated Feb. 16, 2023 (PCT/ISA/210).

*Primary Examiner* — Tho V Duong
(74) *Attorney, Agent, or Firm* — Sughrue Mion, PLLC

(57) ABSTRACT

An integrated plate-type heat exchanger includes: a condenser configured to condense refrigerant by heat exchange between first coolant and the refrigerant; a chiller configured to cool second coolant by heat exchange between the refrigerant passing through the condenser and the second coolant; an internal heat exchanger configured to facilitate heat exchange between the refrigerant coming from the condenser and the refrigerant coming from the chiller; an expansion valve configured to expand the refrigerant discharged from the internal heat exchanger; a connecting plate unit positioned between the internal heat exchanger and the chiller to form a flow path for the refrigerant; and one or more refrigerant outlets to discharge the refrigerant from the (Continued)

connecting plate unit. The connecting plate unit comprises first and second connecting plates positioned to adhere to each other. The first and second connecting plates include one or more through holes for movements of the refrigerant between the internal heat exchanger, the chiller, the expansion valve, and the refrigerant discharge port, and one or more refrigerant spaces for movement of the refrigerant between the first and second connecting plates.

4 Claims, 4 Drawing Sheets

(56) References Cited

U.S. PATENT DOCUMENTS

| | | | | |
|---|---|---|---|---|
| 2012/0210746 | A1* | 8/2012 | Kadle | B60H 1/32284 165/166 |
| 2012/0222846 | A1* | 9/2012 | Kadle | B60H 1/00342 165/166 |
| 2016/0320141 | A1 | 11/2016 | Barfknecht et al. | |
| 2018/0274406 | A1 | 9/2018 | Dries et al. | |
| 2018/0320980 | A1 | 11/2018 | Coban et al. | |

FOREIGN PATENT DOCUMENTS

| | | | | | |
|---|---|---|---|---|---|
| KR | 10-1909658 | B1 | | 10/2018 | |
| KR | 20200006489 | A | * | 1/2020 | F28F 3/048 |
| KR | 10-2020-0011149 | A | | 2/2020 | |
| KR | 20200011149 | A | * | 2/2020 | F25B 39/04 |
| KR | 20200065180 | A | * | 6/2020 | F28F 9/26 |
| KR | 10-2020-0065180 | A | | 10/2023 | |
| WO | 2010-060657 | A1 | | 6/2010 | |

* cited by examiner

【FIG. 1】
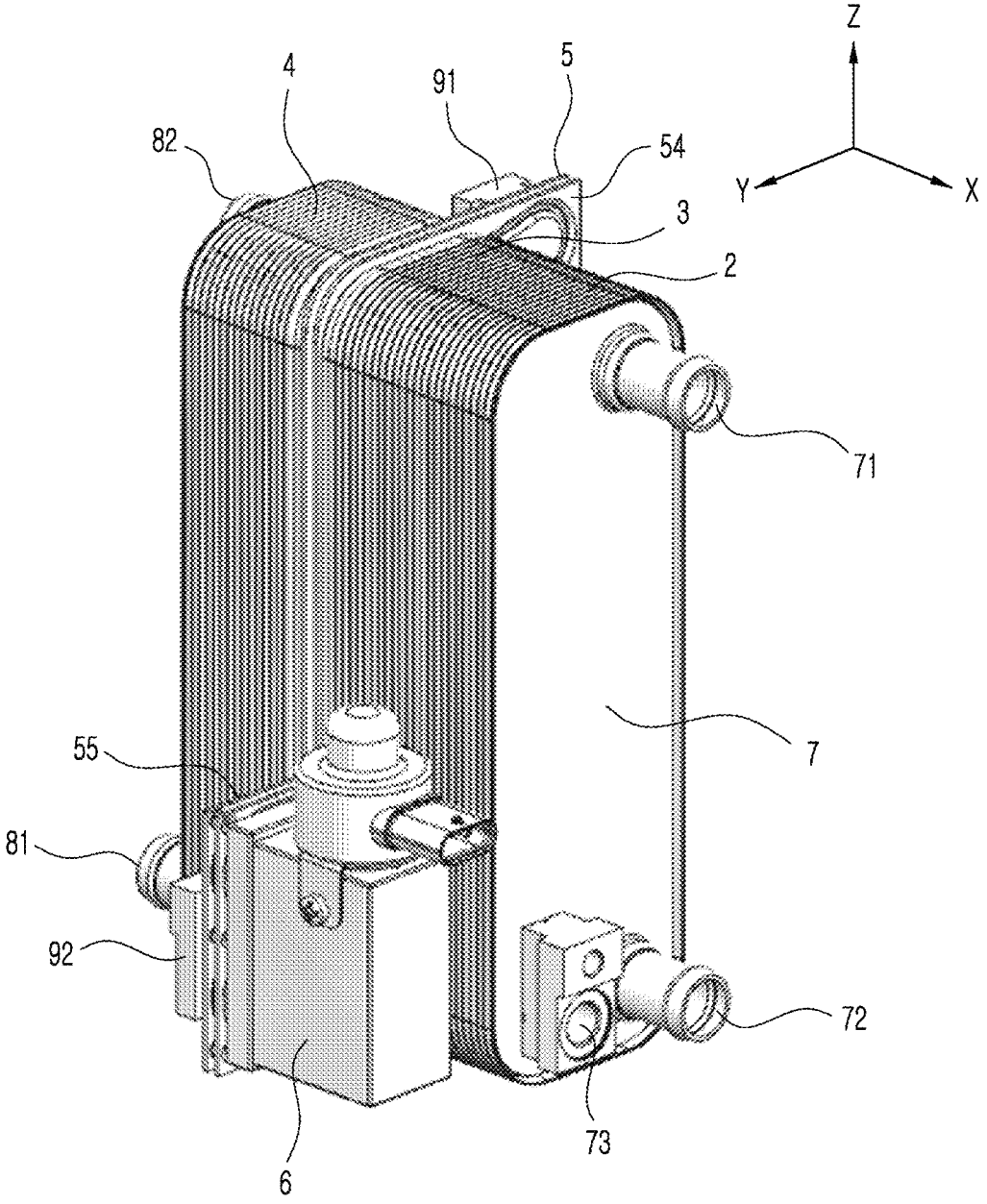

【FIG. 2】
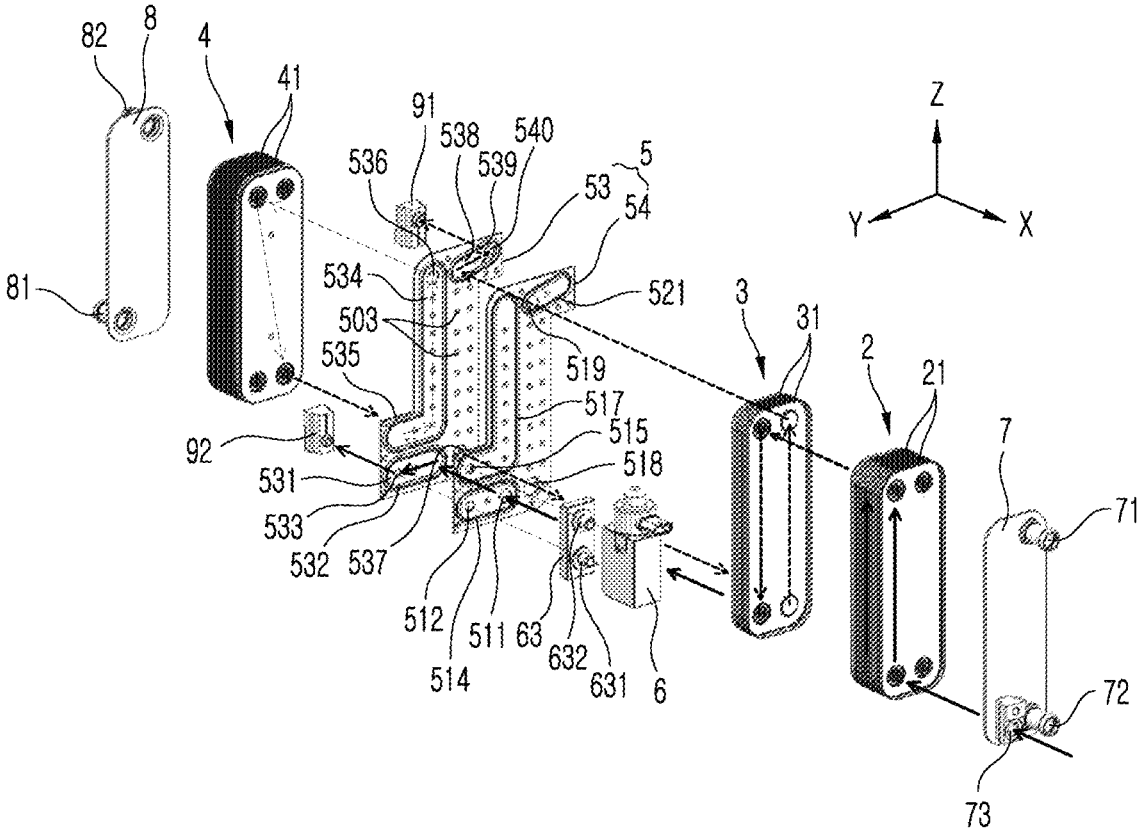

【FIG. 3】
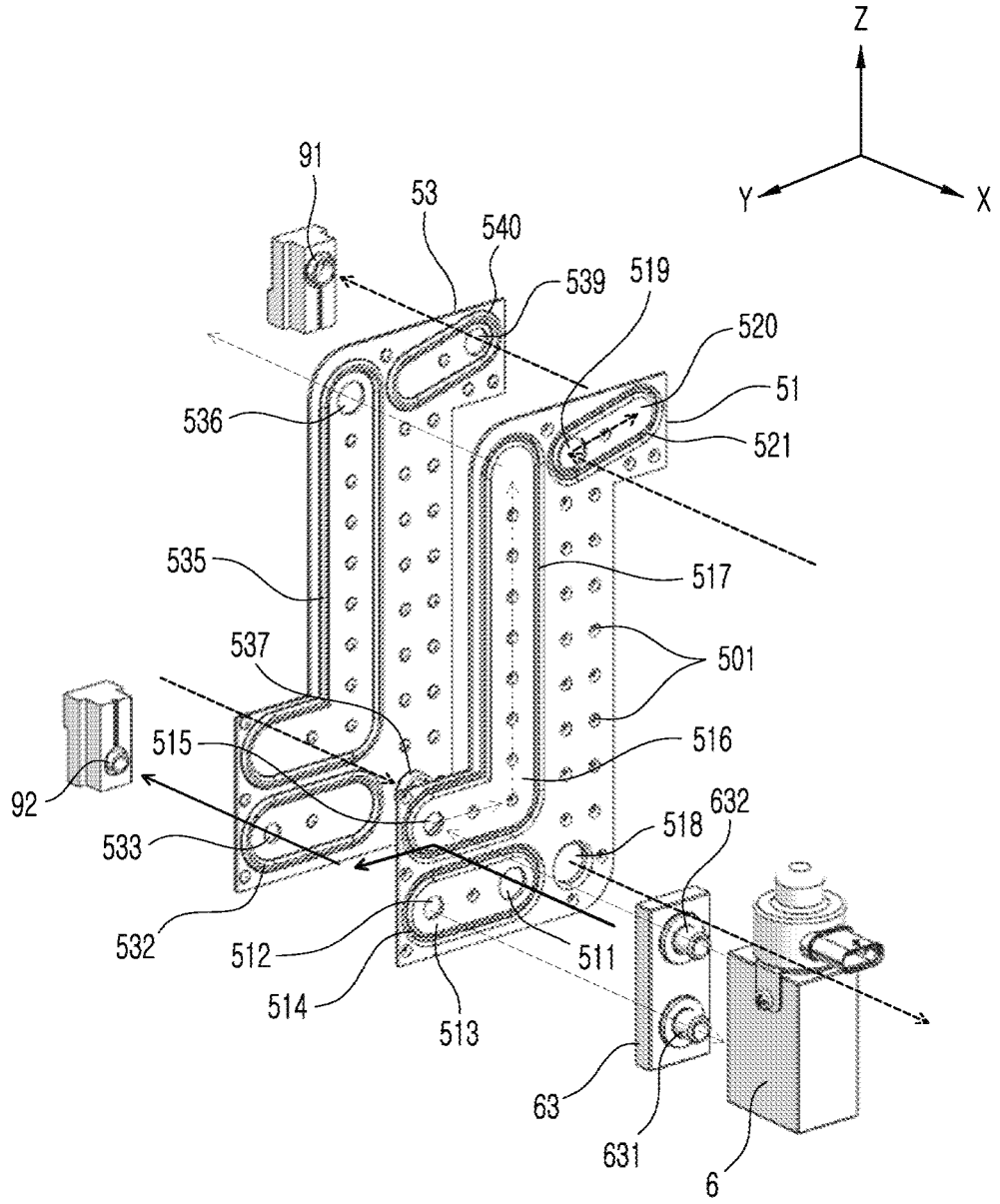

【FIG. 4】
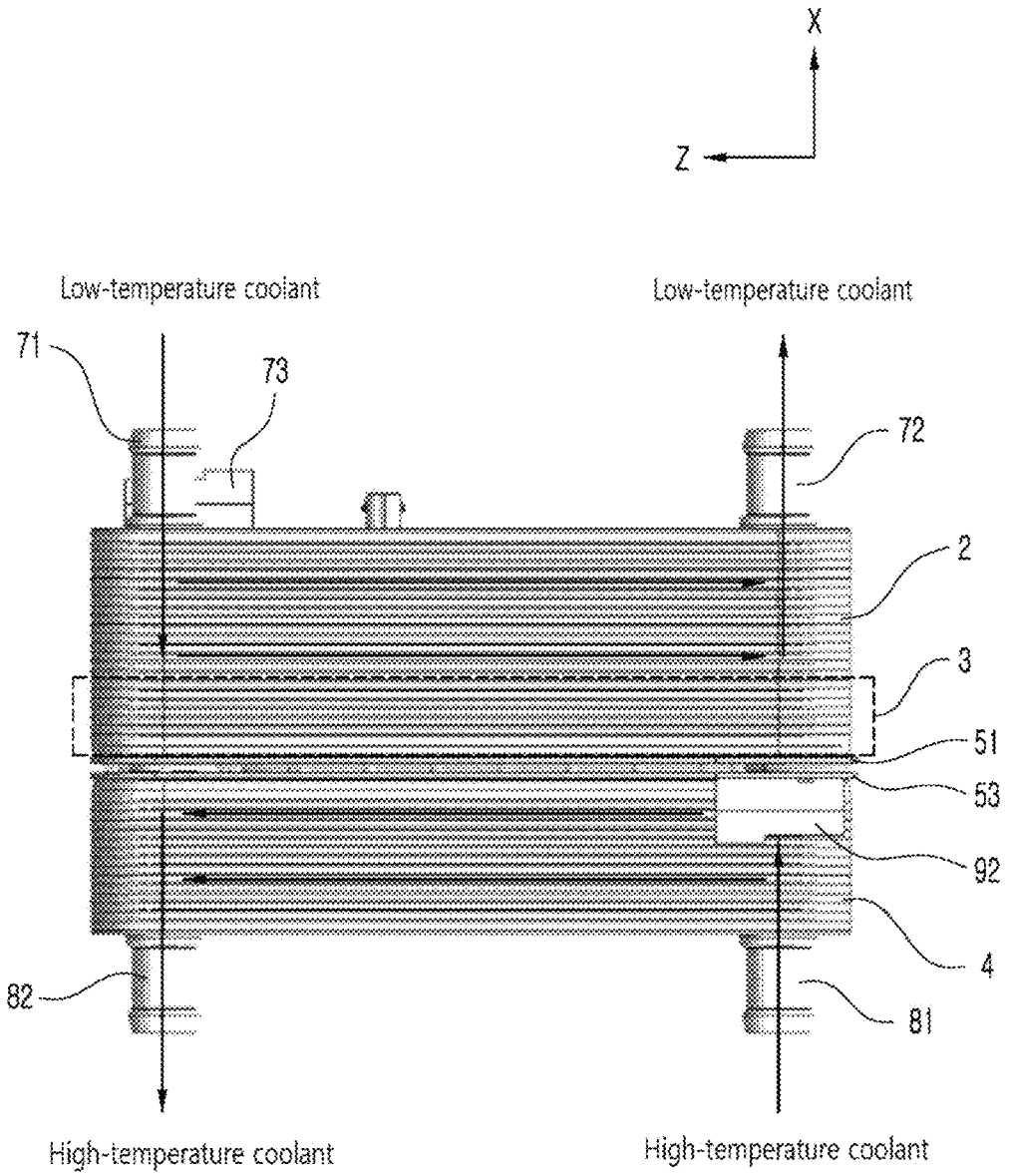

INTEGRATED PLATE-TYPE HEAT EXCHANGER

CROSS REFERENCE TO RELATED APPLICATIONS

This application is a National Stage of International Application No. PCT/KR2022/017965 filed Nov. 15, 2022, claiming priority based on Korean Patent Application No. 10-2021-0162283 filed Nov. 23, 2021.

TECHNICAL FIELD

The present invention relates to a heat exchanger of a vehicle.

BACKGROUND ART

Electric vehicles, compared to internal combustion engine vehicles, have less waste heat energy, and therefore, an integrated thermal management system is being developed to collect and recycle waste heat from a cabin, batteries, and electronic components using coolant as a medium. Research on making the integrated thermal management system lighter and more compact is actively ongoing to increase the driving range of an electric vehicle, and an application of water-cooled heat exchangers is increasing to improve heating efficiency during the winter.

A water-cooled heat exchangers used in a thermal management system of an electric vehicle include a chiller, a water-cooled condenser, and an internal heat exchanger (IHX), or the like, and there are problems in that an assembly process becomes more complex due to pipes and valves connecting these components and a performance loss in a system occurs due to pressure drops in coolant and refrigerant flows in the pipes.

PRIOR ART DOCUMENTS

U.S. Pat. No. 10,480,871 (2019 Nov. 19.)

U.S. patent publication No. US2018/0274406 (2018 Sep. 27.)

U.S. patent publication No. US2016/0320141 (2016 Nov. 3.)

Korean patent publication No. 10-2018-0092543 (2018 Aug. 20.)

DESCRIPTION OF THE INVENTION

Technical Problems

An objection to be solved by the present invention is to provide an integrated plate-type heat exchanger that can reduce both the length of piping connecting each water-cooled heat exchanger and the assembling process, and also reduce the pressure drop caused by the flow of refrigerant and coolant.

Technical Solutions

An integrated plate-type heat exchanger according to an embodiment of the present invention includes: a condenser configured to condense refrigerant by heat exchange between first coolant and the refrigerant; a chiller configured to cool second coolant by heat exchange between the refrigerant passing through the condenser and the second coolant; an internal heat exchanger configured to facilitate heat exchange between the refrigerant coming from the condenser and the refrigerant coming from the chiller; an expansion valve configured to expand the refrigerant discharged from the internal heat exchanger; a connecting plate unit positioned between the internal heat exchanger and the chiller to form a flow path for the refrigerant; and one or more refrigerant outlets to discharge the refrigerant from the connecting plate unit. The connecting plate unit comprises first and second connecting plates positioned to adhere to each other. The first and second connecting plates include one or more through holes for movements of the refrigerant between the internal heat exchanger, the chiller, the expansion valve, and the refrigerant discharge port, and one or more refrigerant spaces for movement of the refrigerant between the first and second connecting plates.

The connecting plate unit may form: a first refrigerant passage to supply at least a portion of the refrigerant discharged from the internal heat exchanger after being supplied from the condenser to the internal heat exchanger to the expansion valve; a second refrigerant passage to supply the refrigerant discharged from the expansion valve to the chiller; a third refrigerant passage to supply the refrigerant discharged from the chiller to the internal heat exchanger; a fourth refrigerant passage for the refrigerant discharged from the chiller after passing through the internal heat exchanger to discharge to an outside; and a fifth refrigerant passage to discharge a portion of the refrigerant discharged from the internal heat exchanger after being supplied from the condenser to the internal heat exchanger to an outside.

The first and second connecting plates may include a plurality of support protrusions formed on facing surfaces thereof.

The refrigerant space may be formed by facing dams protruding on surfaces of the first and second connecting plates.

Effects of the Invention

According to the present invention, by placing the connecting plate unit between the internal heat exchanger and the chiller to form multiple refrigerant pathways, it is possible to reduce the length of piping and the assembly process, as well as decrease the pressure drop caused by the flow of refrigerant and coolant.

BRIEF DESCRIPTION OF THE DRAWINGS

FIG. 1 is a perspective view of an integrated plate-type heat exchanger according to an embodiment of the invention.

FIG. 2 is an exploded perspective view of an integrated plate-type heat exchanger according to an embodiment of the invention.

FIG. 3 is an exploded perspective view of a connecting plate unit and an expansion valve of an integrated plate-type heat exchanger according to an embodiment of the invention.

FIG. 4 is a drawing showing the flow of coolant in an integrated plate-type heat exchanger according to an embodiment of the invention.

EMBODIMENTS FOR CARRYING OUT THE INVENTION

Hereinafter, embodiments of the present invention are described in detail with reference to the accompanying drawings.

Referring to FIG. 1 and FIG. 2, an integrated plate-type heat exchanger according to an embodiment of the invention includes three plate-type heat exchangers, i.e., a condenser 2, an internal heat exchanger 3, and a chiller 4. The condenser 2, the internal heat exchanger 3, and the chiller 4 are respectively formed as a plate-type heat exchanger and are arranged in sequence adjacent to each other to form a stacked structure. A connecting plate unit 5 forms a refrigerant piping for the flow of refrigerant and is placed between the internal heat exchanger 3 and the chiller 4.

The condenser 2, the internal heat exchanger 3, and the chiller 4 include a plurality of heat exchange plates 21, 31 and 41, respectively. The heat exchange plates 21, 31 and 41 are respectively approximately rectangular in shape and may be formed to have the same size as each other. The connecting plate unit 5 includes two connecting plates 51 and 53 that are arranged to face each other, and the two connecting plates 51 and 53 are arranged in close contact to form the refrigerant pathway. The connecting plate unit 5 may form: a first refrigerant pathway for supplying at least part of the refrigerant discharged from the internal heat exchanger 3 to the expansion valve 6 after being supplied from the condenser 2 to the internal heat exchanger 3; a second refrigerant pathway for supplying the refrigerant discharged from the expansion valve 6 to the chiller 4; a third refrigerant pathway for supplying the refrigerant discharged from the chiller 4 to the internal heat exchanger 3; a fourth refrigerant pathway for discharging to the outside the refrigerant that has passed through the internal heat exchanger 3 after being discharged from the chiller 4; and a fifth refrigerant pathway for discharging part of the refrigerant to the outside after being supplied from the condenser 2 to the internal heat exchanger 3 and discharged from the internal heat exchanger 3. The connecting plate unit 5 may have a similar shape to the condenser 2, the internal heat exchanger 3, and the chiller 4, and may include protrusions 54 and 55 protruding outwardly (in the Y-axis direction in FIG. 1) for the coupling of refrigerant outlets 91 and 92 and an expansion valve 6.

In FIG. 2 and FIG. 3, the refrigerant flow of the integrated plate-type heat exchanger according to an embodiment of the invention is shown with arrows. In FIG. 4, the flow of the coolant is indicated with arrows, and the expansion valve is omitted. Below, referring to FIGS. 2 through 4, the flow of coolant and refrigerant according to an embodiment of the invention, and the heat exchange between the coolant and refrigerant, as well as the heat exchange between refrigerants, are described.

The condenser 2 may include a plurality of heat exchange plates 21 that are stacked in sequence, and may be configured to facilitate heat exchange between the coolant and the refrigerant for the condensation of the refrigerant. A cover plate 7 may be positioned on the exterior of the condenser 2, equipped with a coolant inlet 71 through which the coolant enters, a coolant outlet 72 through which the coolant is discharged, and a refrigerant inlet 73 for the entry of refrigerant. The coolant inlet 71, the coolant outlet 72, and the refrigerant inlet 73 may all be located on the side of the condenser 2 in the thickness direction, that is, on the side in the X-axis direction. The coolant and the refrigerant that enter the condenser 2 alternately fill the spaces formed between the heat exchange plates 21, and the heat from the refrigerant is transferred to the coolant through heat exchange via the heat exchange plates 21. This alternating filling of the coolant and the refrigerant, as well as their flow, can be facilitated by tubular members that cross the spaces between the heat exchange plates 21. As shown in FIG. 4, the relatively cold coolant capable of cooling the refrigerant enters through the coolant inlet 71 and flows inside the condenser 2, and is then discharged through the coolant outlet 72.

The refrigerant entering through the refrigerant inlet 73 is cooled and condensed by heat exchange in the condenser 2 and then flows to the internal heat exchanger 3. The internal heat exchanger 3 is configured to receive refrigerant from the condenser 2 on one hand and, on the other hand, to receive refrigerant that has been discharged therefrom and then circulated through the connecting plate unit 5, the expansion valve 6 and the chiller 4. The internal heat exchanger 3 is designed to facilitate heat exchange between the refrigerant coming from the condenser 2 and the refrigerant that has been reentered after circulating through the chiller. The refrigerant from the condenser 2 and the refrigerant from the chiller 4 alternately fill the spaces between the sequentially arranged heat exchange plates 31, where the heat exchange between the refrigerant flows occurs through the plates 31. At this point, the refrigerant from the condenser 2 is in a high-pressure, medium-temperature state, while the refrigerant from the chiller 4 is in a low-temperature, low-pressure state, and due to this temperature gradient, the heat from the refrigerant coming from the condenser 2 is transferred to the refrigerant coming from the chiller 4. Through this heat exchange between the refrigerants, the refrigerant coming from the condenser 2 can be further cooled, and the refrigerant coming from the chiller 4 can be further heated.

The refrigerant is additionally cooled as it passes through the internal heat exchanger 3, and the refrigerant discharged from the internal heat exchanger 3 is introduced into the connecting plate unit 5. The connecting plate unit 5 is configured to discharge a portion of the introduced refrigerant through the refrigerant outlet 92 and supply the remaining refrigerant through the expansion valve 6. The refrigerant discharged through the refrigerant outlet 92 can be supplied to the evaporator of HVAC module.

Some of the refrigerant introduced from the internal heat exchanger 3 to the connecting plate unit 5 is supplied to the expansion valve 6, which is configured to facilitate the expansion of the refrigerant. The refrigerant passing through the expansion valve 6 becomes more evaporable, and the refrigerant discharged from the expansion valve 6 is supplied again to the chiller 4 via the connecting plate unit 5.

The chiller 4 is designed to facilitate heat exchange between the coolant requiring cooling and the refrigerant supplied from the expansion valve 6. The chiller 4 is configured to receive coolant through a cover plate 8 that adheres to its outer surface. The cover plate 8 is equipped with a coolant inlet 81 and a coolant outlet 82, and the coolant introduced through the coolant inlet 81 flows through the chiller 4 and then discharged through the coolant outlet 82. As shown in FIG. 4, relatively hot coolant requiring cooling is introduced through the coolant inlet 81, flows through the chiller 4, and is then discharged through the coolant outlet 82. The coolant inlet 81 and the coolant outlet 82 are positioned on the thickness direction (X-axis direction) side of the heat exchanger, and thus, the coolant inlet 71 and the coolant outlet 72 for the condenser 2 and the coolant inlet 81 and the coolant outlet 82 for the chiller 4 are disposed side surfaces opposite to each other.

The chiller 4 is provided with a plurality of stacked heat exchange plates 41, and the coolant and the refrigerant are alternately filled in the spaces formed between the plurality of heat exchange plates 41, where heat exchange occurs through the heat exchange plates 41. During this process, heat from the coolant is transferred to the refrigerant, causing the coolant to be cooled and the refrigerant to evaporate.

The refrigerant discharged from the chiller 4 is supplied to the internal heat exchanger 3 through the connecting plate unit 5, and the refrigerant supplied to the chiller 4 undergoes heat exchange with the refrigerant supplied from the condenser 2 to the internal heat exchanger 3 before being discharged again to the connecting plate unit 5. The internal heat exchanger 3 includes a plurality of stacked heat exchange plates 31, and the refrigerant supplied from the condenser 2 and the refrigerant supplied from the chiller 4 alternate to fill the space between the plurality of heat exchange plates 31 for heat exchange to occur.

The refrigerant discharged from the internal heat exchanger 3 passes through the connecting plate unit 5 and is then discharged through the refrigerant outlet 91. For example, the refrigerant discharged through the refrigerant outlet 91 can be supplied to the compressor of the HVAC module.

The connecting plate unit 5 is configured to implement the refrigerant flow as described above, and the detailed configuration of the connecting plate unit 5 will be described referring to FIG. 2 and FIG. 3.

As depicted in FIG. 2 and FIG. 3, the connecting plate unit 5 comprises first and second connecting plates 51 and 53 that adhere facing each other. The first connecting plate 51 adheres to the internal heat exchanger 3, while the second connecting plate 53 adheres to the chiller 4. The first and second connecting plates 51 and 53 adhere to each other to form the refrigerant flow path as described above.

The first connecting plate 51 includes a through hole 511 through which the refrigerant discharged from the internal heat exchanger 3 flows. The first and second connecting plates 51 and 53 respectively have a first refrigerant space 513 and 531 into which the refrigerant introduced through the through hole 511 is filled. These first refrigerant spaces 513 and 531 can be formed by dams 514 and 532 protruding from the faces facing each other of the first connecting plate 51 and the second connecting plate 53, thereby forming a single refrigerant space. The first refrigerant spaces 513 and 531 can extend along the protrusion 55 from a position corresponding to the through hole 511. Additionally, the first connecting plate 51 may include a through hole 512 communicating with the first refrigerant spaces 513 and 531 to supply the refrigerant to the expansion valve 6, and the second connecting plate 53 may include a through hole 533 communicating with the first refrigerant spaces 513 and 531 to supply the refrigerant to the refrigerant outlet 92.

Referring to FIG. 3, the expansion valve 6 may be equipped with a refrigerant inlet to receive refrigerant from the through hole 512 of the first connecting plate 51 and a refrigerant outlet through which refrigerant is discharged. The first connecting plate 51 may be equipped with a through hole 515 to receive refrigerant from the refrigerant outlet of the expansion valve 6. A coupler 63 may be provided to connect the through holes 512 and 515 of the first connecting plate 51 with the refrigerant inlet and the refrigerant outlet of the expansion valve 6, respectively. The coupler 63 may include a first coupler 631 to connect the through hole 512 of the first connecting plate 51 with the refrigerant inlet of the expansion valve 6 and a second coupler 632 to connect the through hole 515 of the first connecting plate 51 with the refrigerant outlet of the expansion valve 6. The first and second couplers 631 and 632 may have a tubular shape to allow the flow of refrigerant.

As shown in FIG. 2 and FIG. 3, the through holes 512 and 515 of the first connecting plate 51 and a through hole 533 of the second connecting plate 53 may be positioned on the protrusion 55 of the connecting plate unit 5.

The first and second connecting plates 51 and 53 respectively form second refrigerant spaces 516 and 534 that communicates with the through hole 515 of the first connecting plate 51. The second refrigerant spaces 516 and 534 may be formed by dams 517 and 535 protruding from the faces facing each other of the first and second connecting plates 51 and 53. The first and second refrigerant spaces 516 and 534 are interconnected to form a refrigerant space, and the refrigerant introduced through the through hole 515 of the first connecting plate 51 fills this refrigerant space. The second connecting plate 53 may be equipped with a through hole 536 to supply the refrigerant filled in the first and second refrigerant spaces 516 and 534 to the chiller 4, and the refrigerant supplied from the expansion valve 6 is supplied to the chiller 4 through the through hole 536. The second refrigerant spaces 516 and 534 may extend transversely (in the Y-axis direction) from the protrusion 55 where the through hole 515 of the first connecting plate 51 is located and then extend upward (in the Z-axis direction) toward the through hole 536 of the second connecting plate 53.

The second connecting plate 53 may be equipped with a through hole 537 to receive refrigerant from the chiller 4, and the first connecting plate 51 may be equipped with a corresponding through hole 518 formed at a position corresponding to the through hole 537 of the second connecting plate 53. The through hole 518 of the first connecting plate 51 is formed to allow the refrigerant to be supplied to the internal heat exchanger 3. Thus, the refrigerant, after undergoing heat exchange in the chiller 4, is supplied to the internal heat exchanger 3 through the through holes 537 and 518 of the second and first connecting plates 53 and 51, respectively.

The first connecting plate 51 may be equipped with a through hole 519 to receive refrigerant discharged from the internal heat exchanger 3, and the first and second connecting plates 51 and 53 may respectively have third refrigerant spaces 520 and 538 communicating with the through hole 519. The third refrigerant spaces 520 and 538 may be formed by dams 521 and 539 protruding from the faces facing each other of the first and second connecting plates 51 and 53. The second connecting plate 53 may be equipped with a through hole 540 communicating with the third refrigerant space 520 and 538, which is located on the protrusion 54. The third refrigerant spaces 520 and 538 may extend from the portion where the through hole 519 of the first connecting plate 51 is formed along the protrusion 54 where the through hole 540 is formed. Consequently, the refrigerant can be discharged through the refrigerant outlet 91 via the through hole 540 of the second connecting plate 53.

Meanwhile, the first and second connecting plates 51 and 53 may be equipped with a plurality of supporting protrusions 501 and 503 protruding on the faces facing each other. The supporting protrusions 501 and 503 of the first and second connecting plates 51 and 53 can be formed at corresponding positions to support each other when the first and second connecting plates 51 and 53 are assembled in a state where they contact each other. This allows the first and second connecting plates 51 and 53 to be stably supported in a stacked structure of multiple plates in an integrated plate-type heat exchanger. The supporting protrusions 501 and 503 can be formed at approximately the same height as the dams 514, 517, 521, 532, 535 and 539 formed on the faces facing each other of the first and second connecting plates 51 and 53 to form the first to third refrigerant spaces.

Although the embodiments of the present invention have been described above, the scope of rights of the present invention is not limited thereto, and it encompasses all changes and modifications that are easily made by those skilled in the technical field to which the present invention pertains and are deemed equivalent thereto.

INDUSTRIAL APPLICABILITY

The present invention relates to a heat exchanger that can be used in vehicles, thus it has an industrial applicability.

The invention claimed is:

1. An integrated plate-type heat exchanger, comprising:

a condenser configured to condense refrigerant by heat exchange between first coolant and the refrigerant;

a chiller configured to cool second coolant by heat exchange between refrigerant passing through the condenser and the second coolant;

an internal heat exchanger configured to facilitate heat exchange between refrigerant coming from the condenser and refrigerant coming from the chiller;

an expansion valve configured to expand refrigerant discharged from the internal heat exchanger;

a connecting plate unit positioned between the internal heat exchanger and the chiller to form a flow path for refrigerant; and one or more refrigerant outlets to discharge refrigerant from the connecting plate unit, wherein the connecting plate unit comprises first and second connecting plates positioned to adhere to each other, and wherein the first and second connecting plates include one or more through holes for movements of refrigerant between the internal heat exchanger, the chiller, the expansion valve, and the one or more refrigerant outlets, and one or more refrigerant spaces for movement of the refrigerant between the first and second connecting plates.

2. The integrated plate-type heat exchanger of claim 1, wherein the connecting plate unit forms:

a first refrigerant passage to supply at least a portion of the refrigerant discharged from the internal heat exchanger after being supplied from the condenser to the internal heat exchanger to the expansion valve;

a second refrigerant passage to supply refrigerant discharged from the expansion valve to the chiller;

a third refrigerant passage to supply refrigerant discharged from the chiller to the internal heat exchanger;

a fourth refrigerant passage for the refrigerant discharged from the chiller after passing through the internal heat exchanger to discharge to an outside; and a fifth refrigerant passage to discharge a portion of the refrigerant discharged from the internal heat exchanger after being supplied from the condenser to the internal heat exchanger to an outside.

3. The integrated plate-type heat exchanger of claim 1, wherein the first and second connecting plates comprise a plurality of support protrusions formed on facing surfaces thereof.

4. The integrated plate-type heat exchanger of claim 1, wherein the one or more refrigerant spaces are formed by facing dams protruding on surfaces of the first and second connecting plates.

* * * * *